US005854471A

United States Patent [19]

Tadokoro et al.

[11] Patent Number: 5,854,471

[45] Date of Patent: Dec. 29, 1998

[54] APPARATUS USING A THERMISTOR WITH A POSITIVE TEMPERATURE COEFFICIENT

[75] Inventors: Tomoaki Tadokoro; Akira Mizoi, both of Shiga-ken; Shinji Omura, Ohmihachiman; Tomomi Okada, Youkaichi; Osamu Watanabe, Hikone, all of Japan

[73] Assignee: Murata Manufacturing Co., Ltd., Nagaokakyo, Japan

[21] Appl. No.: 835,475

[22] Filed: Apr. 8, 1997

Related U.S. Application Data

[63] Continuation of Ser. No. 513,398, Aug. 10, 1995.

[30] Foreign Application Priority Data

Aug. 10, 1994 [JP] Japan ..... 6-188410

[51] Int. Cl.[6] ..... H05B 3/06; H05B 1/02; F24D 13/00; H01C 7/10

[52] U.S. Cl. ..... 219/540; 219/505; 392/347; 338/22 R

[58] Field of Search ..... 219/202, 504, 219/505, 530, 540; 392/347, 360, 365, 373, 383–385, 482, 502; 338/222, 252, 51, 22 R

[56] References Cited

U.S. PATENT DOCUMENTS

| | | | |
|---|---|---|---|
| 4,387,291 | 6/1983 | Keppel | 219/505 |
| 4,395,623 | 7/1983 | Shimada et al. | 219/544 |
| 4,993,142 | 2/1991 | Burke et al. | 29/621 |
| 5,057,672 | 10/1991 | Bohlender et al. | 219/540 |
| 5,192,853 | 3/1993 | Yeh | 219/540 |
| 5,239,163 | 8/1993 | Brouwers | 219/202 |
| 5,256,857 | 10/1993 | Curhan et al. | 219/202 |
| 5,377,298 | 12/1994 | Yang | 219/530 |
| 5,471,034 | 11/1995 | Kawate et al. | 219/504 |

*Primary Examiner*—Teresa J. Walberg
*Assistant Examiner*—Sam Paik
*Attorney, Agent, or Firm*—Burns, Doane, Swecker & Mathis, LLP

[57] ABSTRACT

A PTC (positive temperature coefficient) thermistor heating apparatus includes two or more heating blocks, each heating block including a PTC thermistor and radiating elements disposed in contact with at least two surfaces of the PTC thermistor; an elastic element disposed between the heating blocks; and insulating elements for holding portions of the radiating elements at the ends of the heating blocks; wherein the heating blocks are biased from each other by an elastic force of the elastic element.

30 Claims, 3 Drawing Sheets

APPARATUS USING A THERMISTOR WITH A POSITIVE TEMPERATURE COEFFICIENT

This application is a continuation of application Ser. No. 08/513,398, filed Aug. 10, 1995.

BACKGROUND OF THE INVENTION

1. Field of The Invention

The present invention relates to a PTC (positive temperature coefficient) thermistor heating apparatus for use in various types of heating and drying systems.

2. Description of the Related Art

Thermistors having a positive temperature coefficient (PTC) are widely used as a heating element of a heater such as a fan forced-air heater, bedding dryer, or hair dryer. When the temperature of a thermistor of this type increases due to self-heating, its positive temperature coefficient results in an increase in its resistance and thus the temperature is maintained constant in a self-controlled manner. This property is advantageously used in many applications. For example, in fan forced-air heaters, a plurality of thermistors having a positive temperature coefficient are electrically coupled with one another, and radiating elements are in thermal contact with the plurality of thermistors, thereby forming a thermistor heating apparatus having a positive temperature coefficient.

FIG. 3 illustrates the conventional thermistor heating apparatus described above. As shown in FIG. 3, the PTC heating apparatus 60 comprises PTC thermistors 1, radiating elements 2, a first terminal 3 and second terminals 4, 4 each acting as an electrical conduction terminal.

Each PTC thermistor 1 essentially comprises a PTC thermistor element which is substantially rectangular and plate-like, with electrodes (not shown) formed on both principal surfaces of the PTC thermistor element. The radiating elements 2 are made of thin aluminum plates having good thermal conductivity, wherein the aluminum plates have the same width as the PTC thermistors 1 and are folded (corrugated) in a wavy form. The first and second terminals are connected to a pair of radiating elements 2, with PTC thermistor elements 1 being disposed between each pair of radiating elements 2.

Each heating block 60*a* of the PTC thermistor heating apparatus 60 includes a plurality (four pieces in the example shown in FIG. 3) of PTC thermistors 1 arranged side by side; radiating elements 2, 2 disposed on both principal surfaces of the PTC thermistors 1 such that the radiating elements 2, 2 are in good electrical and thermal contact with the electrodes of the PTC thermistors 1; and first and second electrodes 3 and 4 connected to one end of each radiating element 2 wherein the radiating elements 2, 2 have opposite electrical potentials across the PTC thermistors 1. One PTC thermistor heating apparatus 60 includes two heating blocks 60*a* which are connected in such a manner that the first electrode 3 is sandwiched between one heating block 60*a* and the other heating block 60*a*, thereby forming an electrical parallel connection.

In each heating block 60*a* of this type of PTC thermistor heating apparatus 60, the PTC thermistors 1 are bonded to the radiating elements 2 via an insulating adhesive. When electric power is supplied to the first electrode 3 and the second electrodes 4, 4, a voltage is applied, via the radiating elements 2, between the electrodes disposed on the two principal surface of PTC thermistors 1. As a result, heat is generated in the PTC thermistors 1. The heat generated in the PTC thermistors 1 is supplied to the outside via the radiating elements 2 and thus the PTC thermistor heating apparatus 60 acts as a heater.

In the PTC thermistor heating apparatus described above, if the PTC thermistors 1 are bonded to the radiating elements 2 using an electrically conductive adhesive, the electrically conductive adhesive may be deposited on the edge faces of the PTC thermistors 1 and establish other electrically conductive routes, which results in an electrical short circuit. To avoid this problem, the bonding is accomplished in such a way that an insulating adhesive is coated on electric contact faces, and the electric contact faces are then bonded together while being pressed against each other by sufficient magnitude of force to achieve a good electric contact. However, this technique has a disadvantage that an electric contact often fails.

Another problem of the above described conventional technique is that the adhesive which bonds the PTC thermistors 1 to the radiating elements 2 is degraded due to thermal stress or heat cycles continually applied to the apparatus, which can finally lead to separation at the bonding faces.

SUMMARY OF THE INVENTION

It is an object of the present invention to solve the above problems. More specifically, it is an object of the present invention to provide a PTC thermistor heating apparatus having high reliability in which PTC thermistors are electrically and thermally coupled to radiating elements without using an adhesive.

The above objects are achieved by the present invention having various aspects and features described below. According to an aspect of the present invention, there is provided a PTC thermistor heating apparatus including two or more heating blocks, each heating block including a PTC thermistor and radiating elements in contact with at least two surfaces (for example, two principal surfaces) of the PTC thermistor; an elastic element disposed between the heating blocks; and insulating elements for holding portions of radiating elements at the ends of the heating blocks, wherein the heating blocks are biased, or repelled, from each other by means of an elastic force of the elastic element.

In an exemplary embodiment of the invention, the above-described elastic element is a spring made of metal.

In another embodiment of the invention, the above-described insulating element is made of a ceramic or plastic material.

In still another embodiment of the invention, a reinforcing element is disposed between the elastic element and the radiating elements.

In yet another embodiment of the invention, the reinforcing element is disposed at an outermost position of the heating block.

In another embodiment of the invention, the reinforcing element is made of metal.

In an embodiment of the invention in which the elastic element is disposed between heating blocks, good electrical and thermal connection is achieved between the PTC thermistors and radiating elements without using any adhesive.

BRIEF DESCRIPTION OF THE DRAWINGS

The present invention can be further understood with reference to the following description and the appended drawings, wherein like elements are provided with the same reference numerals. In the drawings.

DETAILED DESCRIPTION OF THE PREFERRED EMBODIMENTS

Figure 1:
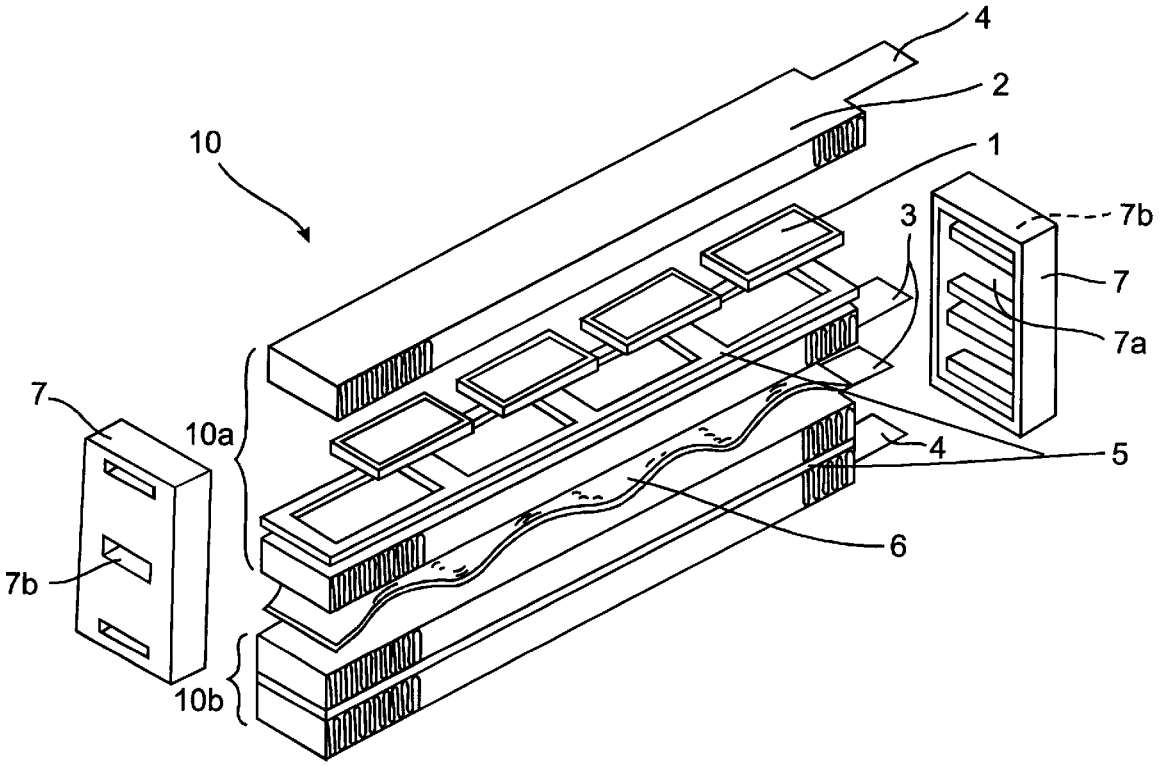
FIG. 1 is (an exploded) perspective view of an exemplary embodiment of a PTC thermistor heating apparatus according to the present invention.
Figure 3:
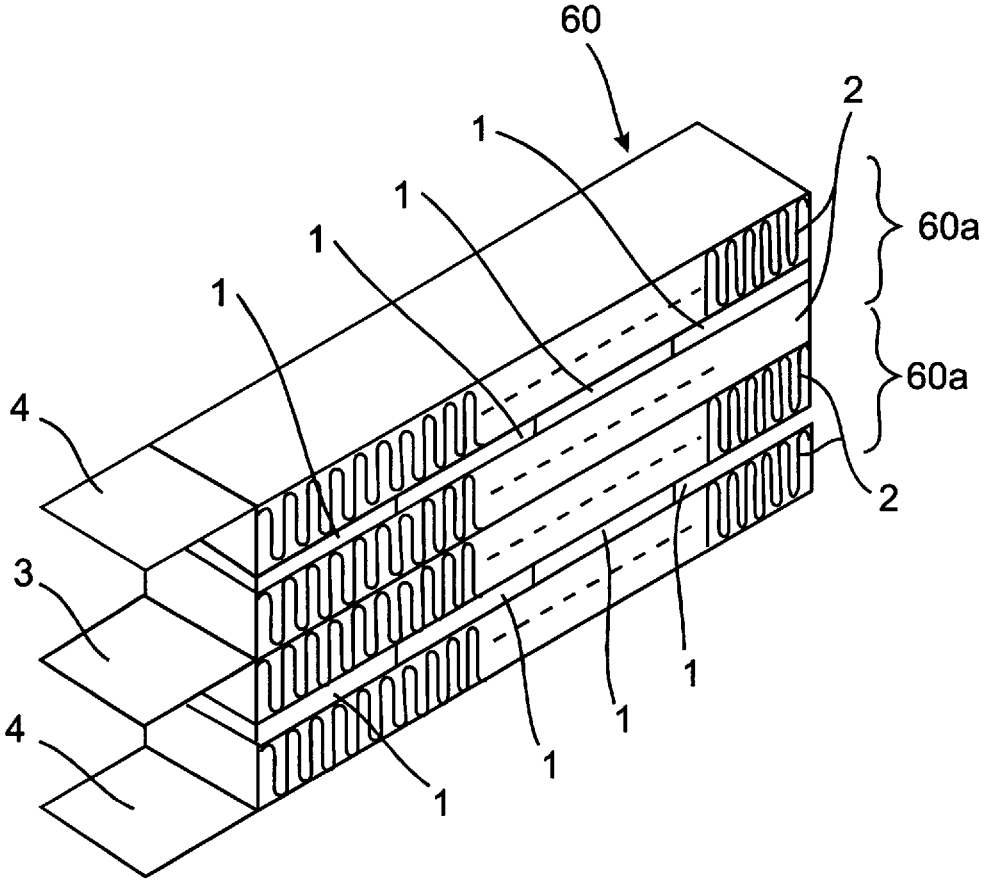
FIG. 3 (PRIOR ART)
FIG. 3 is (an exploded) perspective view of a conventional PTC thermistor heating apparatus.

Referring to FIG. 1, a preferred embodiment of the present invention is described in detail below. In FIG. 1, similar parts to those in the example described above in connection with FIG. 3 are denoted by the same reference numerals as those in FIG. 3, and these parts will not be described here again. Exemplary embodiments of the invention are characterized in that no adhesive is used in producing the apparatus.

As shown in FIG. 1, a PTC thermistor heating apparatus 10 comprises two heating blocks 10*a*, 10*b* each including PTC thermistors 1, radiating elements 2, a first electrode 3, a second electrode 4, and a spacer 5; further, the apparatus includes an elastic plate 6, and two holders 7 made of an insulating material.

The spacers 5 are a thin insulating plate made of, for example, plastic wherein through-holes are formed in central portions thereof so that PTC thermistors 1 (four pieces, in the example shown in FIG. 1) are held in the through-holes. The thickness of the spacers 5 is less than that of the PTC thermistors 1. The spacers 5 can be employed as required.

The elastic plate 6 is made of metal, such as thin stainless steel formed in a wavy form, and acts as a spring. The holders 7 are made of a heat-resistant, insulating material such as ceramic or plastic. Recessed portions 7*a* are formed on one surface of each holder 7 so that the ends of the heating blocks 10*a*, 10*b* can be inserted into the recessed portions 7*a*. Each holder 7 also has through-holes 7*b* into which the first and second terminals 3 and 4 are inserted.

The PTC thermistor heating apparatus 10 is constructed using the above-described components in such a manner that the elastic plate 6 is disposed between two heating blocks 10*a*, 10*b* and both ends of the heating blocks 10*a*, 10*b* are held by the holders 7 while the repulsive elastic force is applied downward and upward to the heating blocks 10*a*, 10*b* by the elastic plate 6.

Thus, in this PTC thermistor heating apparatus 10 according to the present invention, electrical and thermal connection between the PTC thermistors 1 and the radiating elements 2 is accomplished by means of the repulsive force of the elastic plate 6, without using any adhesive. If a voltage is applied between the first electrode 3 and the second electrodes 4, 4, then the voltage is applied, via the radiating elements 2, between the electrodes disposed on the two principal surfaces of the PTC thermistors 1 whereby heat is generated in the PTC thermistors 1. The heat generated in the PTC thermistors 1 is supplied to the outside via the radiating elements 2 and thus the PTC thermistor heating apparatus 10 acts as a heater. In this apparatus, since the connection between the PTC thermistors 1 and the radiating elements 2 is made by means of repulsive elastic force, long-term stability can be achieved in the connection regardless of thermal stress.

Figure 2:
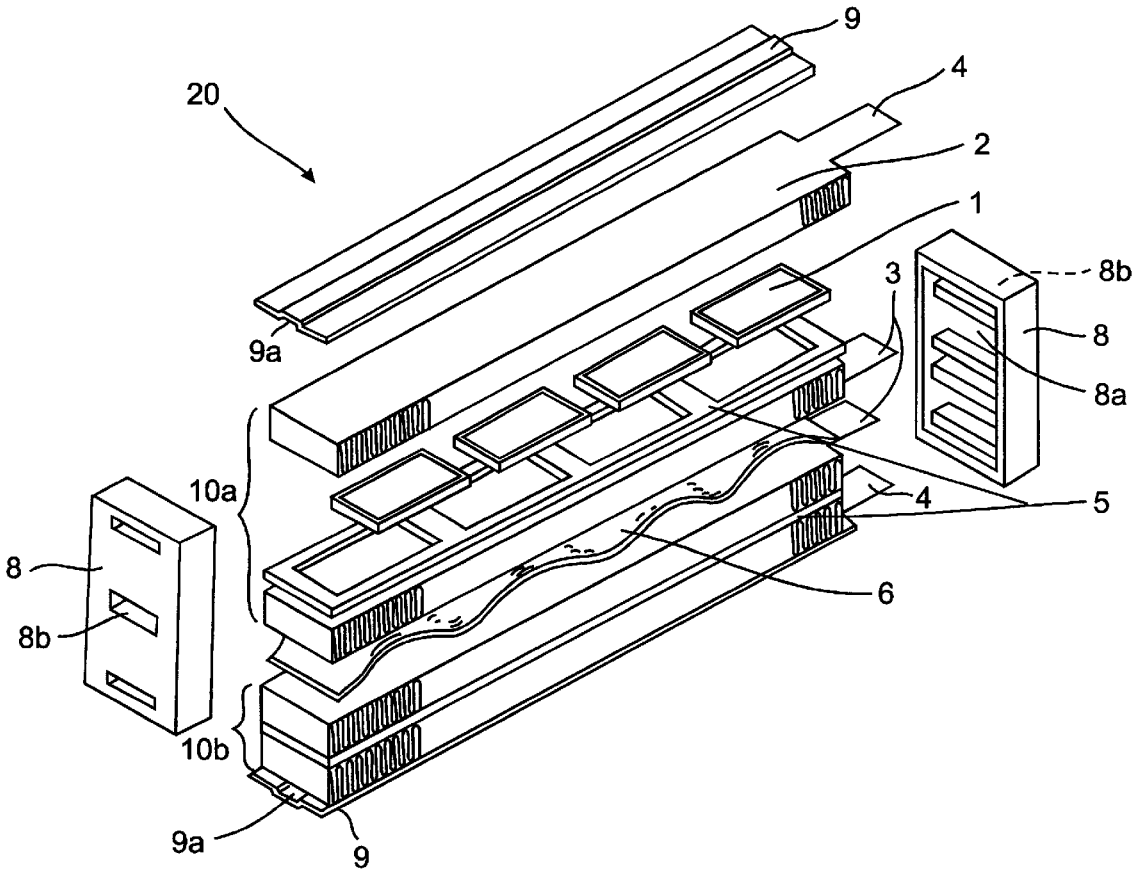
FIG. 2 is (an exploded) perspective view of another embodiment of a PTC thermistor heating apparatus according to the present invention.

Referring to FIG. 2, another embodiment of the invention will be described below. In this embodiment, a PTC thermistor heating apparatus 20 includes two heating blocks 10*a*, 10*b*, an elastic plate 6, two holders 8 made of an insulating material, and reinforcing plates 9.

The holders 8 are made of an electrical insulating material having heat resistance, such as ceramic or plastic. Recessed portions 8*a* are formed on one surface of each holder 8 so that the ends of the heating blocks 10*a*, 10*b* and the reinforcing plates 9 are inserted into the recessed portions 8*a*. Each holder 8 also has through-holes 8*b* into which the first and second terminals 3 and 4 are inserted.

The reinforcing plates 9 are made of metal, such as aluminum, in such a manner that the reinforcing plates 9 have substantially the same size surface area as that of the radiating elements 2.

The PTC thermistor heating apparatus 20 of the FIG. 2 embodiment is similar to the PTC thermistor heating apparatus 10 of the previous embodiment except that the PTC thermistor heating apparatus 20 has the additional reinforcing plates 9 disposed between the elastic plate 6 and the heating blocks 10*a*, 10*b* and/or disposed at the outermost position of the heating blocks 10*a*, 10*b*. In the exemplary embodiment shown in FIG. 2, the two reinforcing plates are formed with a groove (see FIG. 2), and are disposed at both outermost positions of the heating blocks 10*a*, 10*b*.

The PTC thermistor heating apparatus 20 constructed in the manner described above acts as a heater and, as in the PTC thermistor heating apparatus 10, long-term stability in the connection can be achieved regardless of thermal stress. The reinforcing plates 9 disposed between the elastic plate 6 and the radiating elements 2, and/or at the outside of the radiating elements 2, prevent the radiating elements 2 from being deformed by the repulsive force of the elastic plate 6.

In the PTC thermistor heating apparatus 10 or 20 described above, the repulsive force of the elastic plate is set to a proper magnitude selected based on the requirements of specific applications, thereby achieving stable electrical connection between the PTC thermistors 1 and the radiating elements 2. In accordance with exemplary embodiments, electrical and thermal connection for both heating blocks 1O*a*, 10*b* is achieved in a highly efficient manner by using only one elastic plate 6.

Whereas two heating blocks 10*a*, 10*b* are used in the embodiments described above, three or more heating blocks can be used. In this case, two or more elastic plates 6 can be used.

The radiating elements 2 can be made of aluminum although any other materials can also be employed. For example, any material having good thermal conductivity can be used. Furthermore, the radiating elements 2 can be formed not only into a corrugated shape as described with respect to the above examples, but also into any other shapes using any known techniques, such as a die casting or extrusion molding technique.

Furthermore, the shape of the elastic plate 6 is not limited to the wavy shape as in the exemplary embodiments described above, but can, for example, be formed into a coil or washer-like shape so that the resultant structure can produce repulsive force in upward and downward directions.

As described above, in the PTC thermistor heating apparatus according to the present invention, electrical connection is achieved without using any adhesive and thus good and stable electrical conduction can be obtained for a long time.

Furthermore, as opposed to the case where an adhesive is used, the PTC thermistor heating apparatus of the invention has no problems of separation due to degradation of the adhesive.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A PTC thermistor apparatus comprising:

two or more heating blocks, each heating block including a spacer having at at least one through-hole for holding a PTC thermistor, and including radiating elements disposed in contact with at least two surfaces of said PTC thermistor;

an elastic element disposed between said heating blocks;

insulating elements for holding portions of said radiating elements at the ends of said heating blocks, said heating blocks being biased from each other by an elastic force of said elastic element; and a first reinforcing element disposed adjacent to at least one of said heating blocks, said reinforcing element having a groove formed therein, wherein said groove forms at least one space disposed between said reinforcing element and at least one of said heating blocks.

2. A PTC thermistor apparatus according to claim 1, wherein said elastic element is a spring made of metal.

3. A PTC thermistor apparatus according to claim 2, wherein said insulating elements are made of a ceramic material.

4. A PTC thermistor apparatus according to claim 2, wherein said insulating elements are made of a plastic material.

5. A PTC thermistor apparatus according to claim 2, wherein said reinforcing element is disposed between said elastic element and at least one of said radiating elements.

6. A PTC thermistor apparatus according to claim 5, wherein said reinforcing element is made of metal.

7. A PTC thermistor apparatus according to claim 2, wherein said reinforcing element is disposed at an outermost position of at least one of said heating blocks.

8. A PTC thermistor apparatus according to claim 7, wherein said reinforcing element is made of metal.

9. A PTC thermistor apparatus according to claim 2, wherein said spring is made of aluminum.

10. A PTC thermistor apparatus according to claim 1, wherein said insulating elements are made of ceramic material.

11. A PTC thermistor apparatus according to claim 1, wherein said insulating elements are made of a plastic material.

12. A PTC thermistor apparatus according to claim 1, wherein said reinforcing element is disposed between said elastic element and at least one of said radiating elements.

13. A PTC thermistor apparatus according to claim 12, wherein said reinforcing element is made of metal.

14. A PTC thermistor apparatus according to claim 12, wherein said reinforcing element includes a surface area of substantially a same size as that of each of said radiating elements.

15. A PTC thermistor apparatus according to claim 1, wherein said reinforcing element is disposed at an outermost position of at least one of said heating blocks.

16. A PTC thermistor apparatus according to claim 15, wherein said reinforcing element is made of metal.

17. A PTC thermistor apparatus according to claim 1, wherein each of said insulating elements further includes:

at least one recessed portion for receiving an end portion of at least one of said heating blocks.

18. A PTC thermistor apparatus according to claim 1, further comprising:

a first electrode for electrically contacting at least one of said at least two surfaces of said PTC thermistor; and a second electrode for electrically contacting at least one other surface of said at least two surfaces of said PTC thermistor.

19. A PTC thermistor apparatus according to claim 18, wherein each of said insulating elements further includes:

at least one recessed portion for receiving an end portion of at least one of said heating blocks; and at least one through-hole into which at least one of said first electrode and said second electrode is inserted.

20. A PTC thermistor apparatus according to claim 1, wherein each of said insulating elements is formed to hold only one of said ends of said heating blocks.

21. The PTC thermistor apparatus according to claim 1, wherein said reinforcing element includes a planar surface, and said groove comprises a U-shaped recess formed in said planar surface.

22. The PTC thermistor apparatus according to claim 1, further including a second reinforcing element, wherein said two or more heating blocks are disposed between said first and second reinforcing elements.

23. Method for producing a PTC thermistor apparatus comprising the steps of:

forming each of two or more heating blocks with a spacer having at least one through-hole for holding a PTC thermistor, and radiating elements disposed in contact with at least two surfaces of said PTC thermistor;

disposing an elastic element between said heating blocks;

placing insulating elements for holding portions of said radiating elements at the ends of said heating blocks, said heating blocks being biased from each other by an elastic force of said elastic element; and disposing a first reinforcing element having a groove formed therein adjacent to at least one of said heating blocks, wherein said groove forms at least one space disposed between said reinforcing element and at least one of said heating blocks.

24. Method according to claim 23, further comprising the step of:

disposing said reinforcing element between said elastic element and at least one of said radiating elements.

25. A PTC thermistor apparatus according to claim 24, wherein said reinforcing element includes a surface area of substantially a same size as that of each of said radiating elements.

26. Method according to claim 23, further comprising the step of:

disposing said reinforcing element at an outermost position of at least one of said heating blocks.

27. Method according to claim 23, further comprising the step of:

placing a first electrode for electrically contacting at least one of said at least two surfaces of said PTC thermistor; and placing a second electrode for electrically contacting at least one other surface of said at least two surfaces of said PTC thermistor.

28. A PTC thermistor apparatus according to claim 23, wherein each of said insulating elements is formed to hold only one of said ends of said heating blocks without contacting said PTC thermistor.

29. Method according to claim 23, wherein said reinforcing element includes a planar surface, and said groove comprises a U-shaped recess formed in said planar surface.

30. Method according to claim 23, further including a second reinforcing element, wherein said two of more heating blocks are disposed between said first and second reinforcing elements.

* * * * *